US006844735B2

(12) United States Patent
Miwa et al.

(10) Patent No.: US 6,844,735 B2
(45) Date of Patent: Jan. 18, 2005

(54) METHOD FOR INSPECTING IGNITION DEVICE FOR INTERNAL COMBUSTION ENGINE AND INSPECTION DEVICE

(75) Inventors: Tetsuya Miwa, Nagoya (JP); Atsuya Mizutani, Yokkaichi (JP); Hiromi Hiramatsu, Kariya (JP)

(73) Assignee: Denso Corporation, Kariya (JP)

( * ) Notice: Subject to any disclaimer, the term of this patent is extended or adjusted under 35 U.S.C. 154(b) by 8 days.

(21) Appl. No.: 10/628,479

(22) Filed: Jul. 29, 2003

(65) Prior Publication Data

US 2004/0113628 A1 Jun. 17, 2004

(30) Foreign Application Priority Data

Aug. 8, 2002 (JP) ..... 2002-231295

(51) Int. Cl.[7] ..... F02P 17/00
(52) U.S. Cl. ..... 324/380; 324/379; 324/402
(58) Field of Search ..... 123/634, 635, 123/647; 324/379, 380, 402

(56) References Cited

U.S. PATENT DOCUMENTS

| | | | | |
|---|---|---|---|---|
| 5,535,726 A | | 7/1996 | Wilmot et al. | 123/635 |
| 6,119,667 A | | 9/2000 | Boyer et al. | 123/634 |
| 6,216,679 B1 | * | 4/2001 | Skinner et al. | 123/635 |
| 6,411,096 B1 | * | 6/2002 | Anthoni et al. | 324/379 |
| 6,426,626 B1 | * | 7/2002 | Kravis | 324/388 |
| 6,717,412 B1 | * | 4/2004 | Moritz et al. | 324/380 |
| 2003/0038635 A1 | * | 2/2003 | McQueeney et al. | 324/388 |
| 2004/0066198 A1 | * | 4/2004 | Butler et al. | 324/378 |

FOREIGN PATENT DOCUMENTS

| | | |
|---|---|---|
| EP | 907 019 | 4/1999 |
| JP | 2000-277232 | 10/2000 |
| JP | 2002-21695 | 1/2002 |

* cited by examiner

*Primary Examiner*—N. Le
*Assistant Examiner*—Walter Benson
(74) *Attorney, Agent, or Firm*—Nixon & Vanderhye P.C.

(57) ABSTRACT

An inspection object constructed of an ignition plug and an ignition coil is inserted in an inspection housing that does not have a ground electrode. A voltage generated in the ignition coil is measured while the inspection object is housed in the inspection housing. Electrical discharge does not occur because the ground electrode is not provided. Therefore, the voltage generated in the ignition coil is properly measured for quality inspection of the ignition coil.

7 Claims, 4 Drawing Sheets

METHOD FOR INSPECTING IGNITION DEVICE FOR INTERNAL COMBUSTION ENGINE AND INSPECTION DEVICE

CROSS REFERENCE TO RELATED APPLICATION

This application is based on and incorporates herein by reference Japanese Patent Application No. 2002-231295 filed on Aug. 8, 2002.

FIELD OF THE INVENTION

The present invention relates to a method for inspecting an ignition device for an internal combustion engine and an inspection device for the same.

BACKGROUND OF THE INVENTION

Internal combustion engine ignition devices having an ignition plug and an ignition coil that are integrated with each other are proposed in various kinds. For quality inspection of the ignition coil, a voltage generated in the ignition coil is measured. An electrical discharge from the ignition plug must be prevented during the voltage measurement. However, the ignition plug in complete products cannot be prevented from the electrical discharge. As a result, the quality inspection of the ignition coils cannot be properly performed.

SUMMARY OF THE INVENTION

The present invention therefore has an objective to provide a method for quality inspection of an ignition coil that is integrated with an ignition plug and used in an internal combustion engine ignition device. The present invention has another objective to provide an inspection device that enables the quality inspection using the method.

A method of the present invention is provided for inspecting the ignition device with the use of a cylindrical inspection housing. The ignition plug and the ignition coil are housed by a cylindrical ignition device housing that functions as an outer peripheral core of the ignition coil. A ground electrode of the ignition plug is fixed to the housing. The inspection housing does not include the ground electrode. The inspection housing also functions as the outer peripheral core.

The inspection housing having no ground electrode is used for measuring the voltage generated in the ignition coil for quality inspection. Since the housing does not include the ground electrode, no discharge occurs between the ignition plug and the inspection housing. As a result, the voltage is properly measured and the quality of the ignition plug is appropriately determined.

An inspection device of the present invention enables the inspection of the ignition device in the use of the above-described method. The device includes a voltage measuring means for measuring the voltage generated in the ignition coil while the ignition coil is housed in the inspection housing.

BRIEF DESCRIPTION OF THE DRAWINGS

The above and other objectives, features and advantages of the present invention will become more apparent from the following detailed description made with reference to the accompanying drawings. In the drawings.

DETAILED DESCRIPTION OF THE PREFERRED EMBODIMENT

The preferred embodiment of the present invention will be explained with reference to the accompanying drawings.

Figure 1:
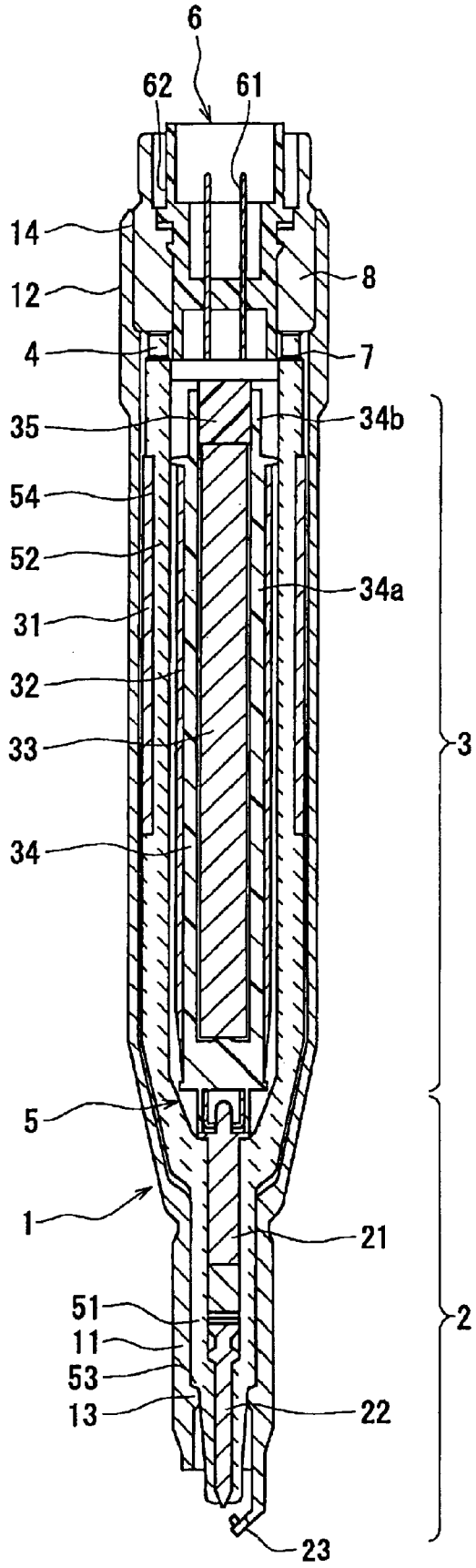
FIG. 1 a sectional view of an ignition device for an internal combustion engine according to an embodiment of the present invention.

A finished product of an ignition device shown in FIG. 1 includes a cylindrical ignition device housing 1, an ignition plug 2, an ignition coil 3, and a pressure sensing element 4. The ignition device housing 1 that is made of a magnetic and conductive material including steel houses the ignition plug 2, the ignition coil 3, and the pressure sensing element 4. The ignition device is fitted in a plug hole in the cylinder head of an internal combustion engine (not shown) in practical use in a manner that electrodes of the ignition plug are exposed.

Figure 2A:
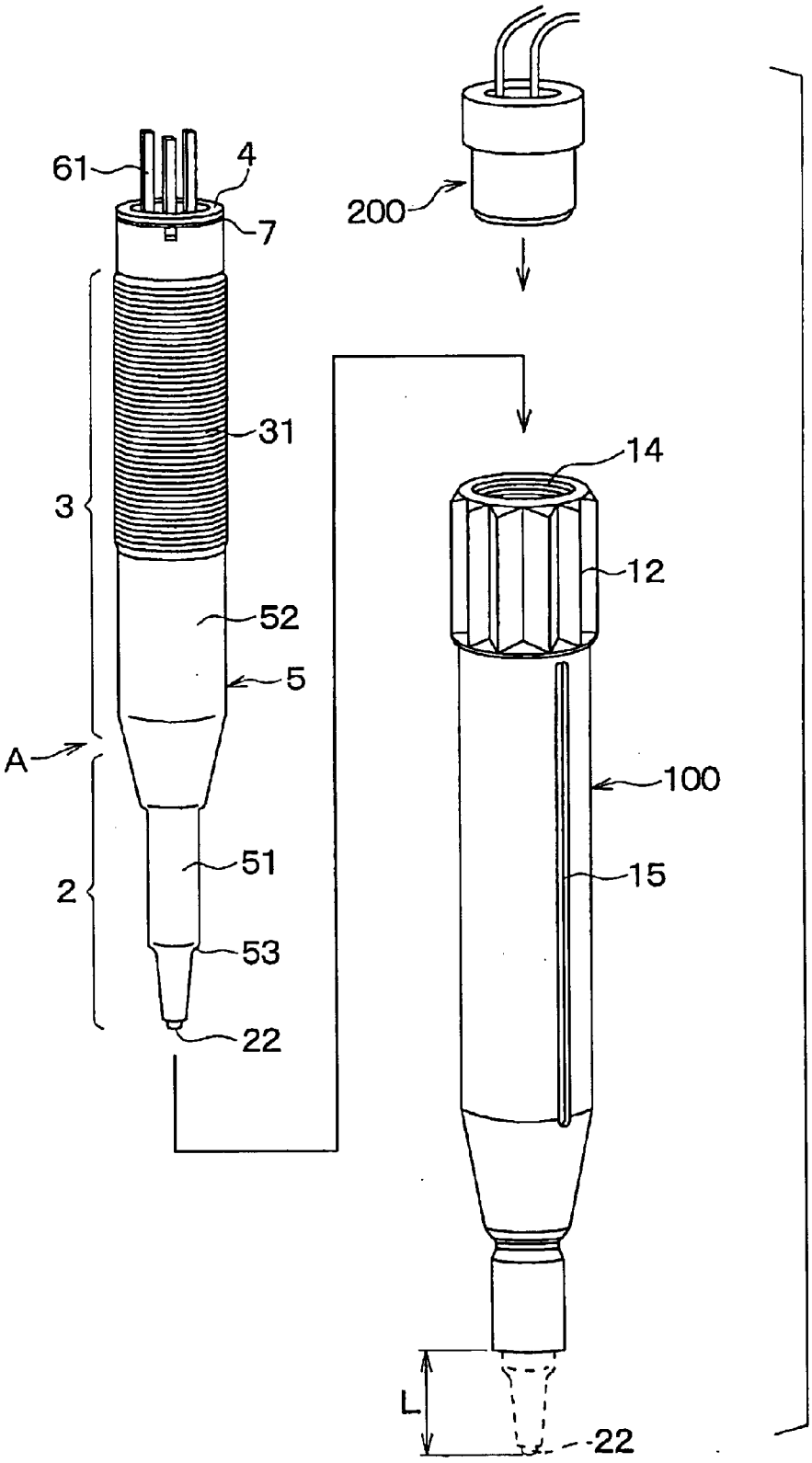
FIG. 2A is an exploded perspective view of an inspection object A included in the ignition device and an inspection housing according to the embodiment.
Figure 2B:
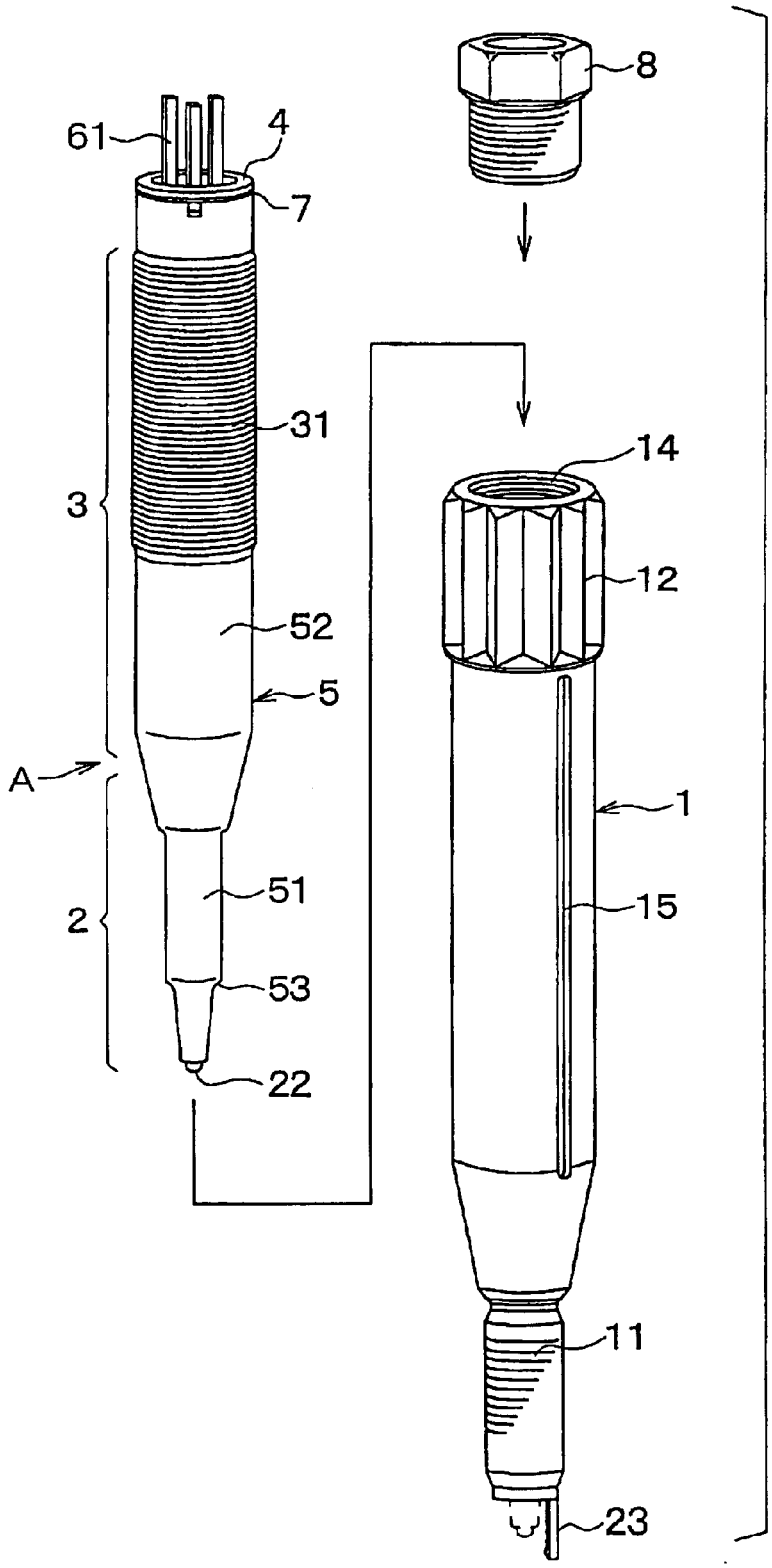
FIG. 2B is an exploded perspective view of the inspection object and an ignition device housing according to the embodiment.

Referring to FIGS. 1 and 2B, a construction of the ignition device, which is fitted in the cylinder head, will be explained. The ignition device housing 1 has a male thread portion 11 at an end adjacent to a combustion chamber of the engine and a nut portion 12 at the other end. The male thread portion 11 is engaged with a female thread portion (not shown) by turning the ignition device housing 1 with the nut portion 12. As a result, the ignition device is fixed to the cylinder head.

The ignition device housing 1 houses a tubular insulator 5 made of ceramic, such as alumina, that provides high electrical insulation. The insulator 5 has a lower tubular portion 51 and a upper tubular portion 52. The lower tubular portion 51 is located adjacent to the combustion chamber and the upper tubular portion 52 extends from the lower tubular portion 51 towards the end away from the combustion chamber.

The ignition device housing 1 has an annular stopper 13 on its inner periphery near the end adjacent to the combustion chamber. The insulator 5 has an annular step 35 on an outer periphery of the lower tubular portion. The annular stopper 13 and the annular step 35 are provided for placing the insulator 5 at a proper axial position in the ignition device housing 1 and for sealing out combustion gas.

The ignition plug 2 is constructed of a stem 21, a center electrode 22, and a ground electrode 23 made of conductive metal. The stem 21 and the center electrode 22 are inserted in a center bore of the insulator 5, which is provided in the upper tubular portion 51. The tip of the center electrode 22, at which an electric discharge occurs, is exposed in the combustion chamber. The ground electrode that is fixed to the ignition device housing 1 by welding faces the tip of the center electrode 22.

The ignition coil 3 is constructed of a primary winding 31, a secondary winding 32, a columnar center core 33, and cylindrical secondary spool 34. The center core 33 and the secondary spool 34 are made of a magnetic material and an electrical insulating resin, respectively. The primary winding 31 is directly wound around the insulator 5 in an annular recess 54 provided in the upper tubular portion 52. Ends of the primary winding 31 are connected to a terminal 61 of a connector 6 via a terminal (not shown) for receiving control signals from an igniter (not shown).

A portion of the ignition device housing 1 that covers the primary winding 31 functions as an outer peripheral core. A slit 15 is provided in the portion to reduce losses caused by the loop currents generated by magnetic flux changes.

The secondary spool 34 has a lower tubular portion 34*a* and an upper tubular portion 34*b* that extends from the lower tubular portion 34*a* towards the end away from the combustion chamber. The secondary winding 32 is wound around the secondary spool 34 in the lower tubular portion 34. A center core 33 is inserted in a center bore of the secondary spool 34. After the center core is inserted, the center bore is sealed with a packing 35 made of an elastic material, such as a rubber and a sponge.

The secondary spool 34 together with the secondary winding 32, the center core 33, and the packing 35 is inserted in the center bore of the insulator 5 provided in the upper tubular portion 52. Then, the center bore is filled with an electrical insulating resin by pouring it from an opening in the upper tubular portion 52 while the top of the insulator 5 is positioned upward. The resin flows into the gap between the insulator 5 and the secondary winding 32, and then hardens to fix the secondary winding 32.

The upper tubular portion 52 is filled with the insulating resin at a level lower than the top of the upper tubular portion 34*b*. The level cannot exceed the top of the upper tubular portion 34*b* to prevent a resin flow into the center bore of this spool 34. The closure 35 of the secondary spool 34 further prevents the resin flow. Accordingly, only the secondary winding 32 is fixed by the insulating resin in the ignition device.

A high voltage end and a low voltage end of the secondary winding 32 are connected to the center electrode 22 and the housing 1 via a terminal (not shown), respectively. The housing 1 is connected to a chassis ground (not shown) via the cylinder head.

With the above-described configuration, a high voltage section and a low voltage section of the ignition coil 3 are completely insulated by the insulator 5. The high voltage section includes the secondary winding 32, and parts that connects the stem 21 with the high voltage end of the secondary winding 32. The low voltage section includes the primary winding 31 and the housing 1.

The pressure sensing element 4 is made of lead titanate and shaped in a lamelliform ring. The electric potential of the element 4 varies according to the pressure applied to the element 4. The element 4 is arranged at the top of the upper tubular portion 52 of the insulator 5 together with a terminal 7 that is made of conductive metal and shaped in a lamelliform ring. The terminal 7 includes integrally-formed connector terminals 61. The top portion of the insulator 5, that is the top end of the upper tubular portion 52, is left for fitting the element 4 when winding the windings 31 and 32 onto the insulator 5.

The top of the housing 1 has a female thread 14 formed in its inner periphery. A tubular bolt 8, which is a holding fixture, is provided for holding the element 4 and the terminal 7 between the bolt 8 and the insulator 5 by engaging it with the female thread 14. The element 4 and the terminal 7 are fitted to the top end of the insulator 5 after the ignition plug 2, the secondary winding 32, the center core 33, the secondary spool 34 are inserted into the insulator 5 that has the primary winding. Then, the insulator 5 is inserted into the housing 1 and the bolt 8 is engaged with the female thread 14 and tightened. As a result, the insulator 5 is pressed against the annular stopper 13 together with the element 4 and the terminal 7.

When the bolt 8 is engaged with the female thread 14, a compressive preload pressure is applied to the element 4. Moreover, no gap between the housing 1 and the insulator 5 is present when the annular step 53 is pressed against the annular stopper 13. Therefore, the combustion gas generated in the combustion chamber is sealed out.

Ends of the element 4 are electrically connected to the housing 1 via the bolt 8 and to the terminal 7 for sending output signals of the element 4 to a control device (not shown). A resin case 62 of the connector 6 is inserted into the bore of the bolt 8 after the bolt 8 is engaged with the female thread 14 and tightened.

A high voltage is generated in the ignition coil 3 based on control signals from the igniter. The high voltage is discharged from the tip of the ignition plug 2 to a spark gap. The spark caused by the discharge ignites the mixture in the combustion chamber. The pressure is developed by the combustion in the combustion chamber and transmitted to the element 4 through the insulator 5, that is, a compressive load pressure is applied to the element 4. The element 4 then outputs a signal responsive to the applied load.

Figure 3:
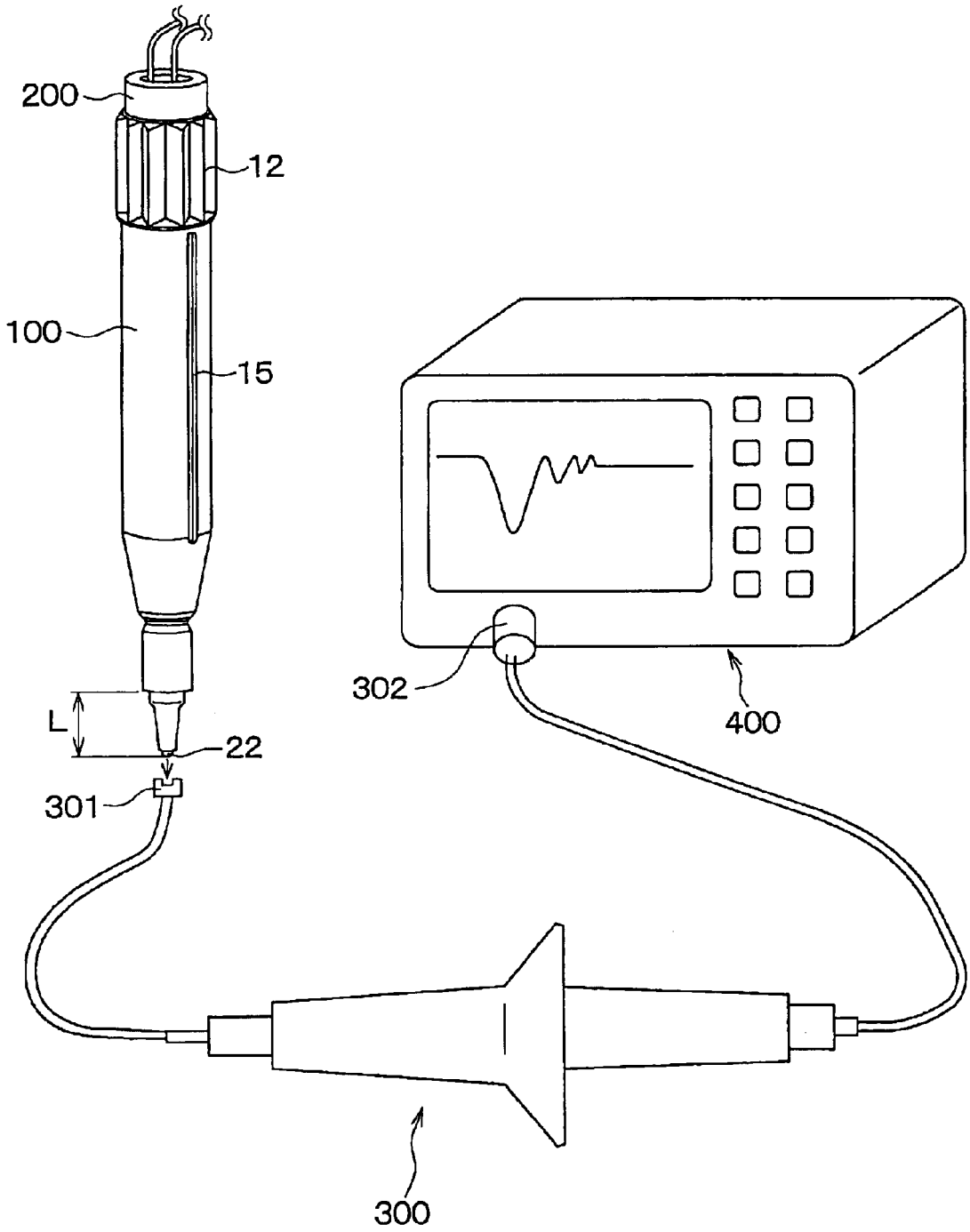
FIG. 3 is a schematic view of an inspection device and a voltage measurement device for the quality inspection of the ignition device according to the first embodiment.

Referring to FIGS. 2A and 3, a method for inspecting the ignition device and an inspection device for the inspection will be explained. The ignition plug 2, the secondary winding 32, the center core 33, and the secondary spool 34 are inserted into the insulator 5 on which the primary winding is wound. Then, the pressure sensing element 4 and the terminal 7 are attached to the top end of the insulator 5 located in the upper tubular portion 52. This assembly is referred to as an inspection object A.

A quality inspection housing 100 and an inspection connector 200 are provided especially for the inspection of the inspection object A. The inspection housing 100 is formed in a cylindrical shape and the inspection object A is inserted in it for the inspection. The inspection connector 200 is connected to the connectors 61 of the inspection object A and power is supplied to the primary winding 31 by a power source (not shown).

The inspection housing 100 is made of the same material as the hosing 1. A portion that functions as an outer peripheral core is formed in the same shape as the portion of the housing 1 having the same function. The inspection housing 100 does not include the ground electrode 23 that is included in the housing 1. The inspection housing 100 is sized so that its lower end is positioned at least a distance L away from the tip of the center electrode 22 when the object A is inserted in the inspection housing 100. The distance L is the minimum distance decided when the maximum voltage generated in the ignition coil 3 is applied to the electrode 22 but the discharge does not occur between the housing 100 and the electrode 22.

It is preferable that the distance L is at least 20 mm to provide perfect isolation. The distance L can be decided based on atmospheric pressure and temperature at which the voltage is measured. More specifically, the distance L can be shorter as the pressure becomes higher or the temperature becomes lower.

A voltage measurement device shown in FIG. 3 includes a high voltage probe 300 and an oscilloscope 400. The voltage generated in the inspection object A inserted in the inspection housing is measured using this device. The high voltage probe 300 includes an input terminal 301 and an output terminal 302. The input terminal 301 and the output terminal 302 are connected to the tip of the center electrode 22 and the oscilloscope 400, respectively. Electrical signals responsive to the voltage applied to the center electrode 22 are inputted to the oscilloscope 400 via the probe 300. The oscilloscope 400 calculates voltage levels and displays the calculated voltage on its monitor.

Power is intermittently supplied to the primary winding 31 while the inspection object is in the inspection housing. Then, the voltages applied to the center electrode 22 and generated in the ignition coil 3 are measured. The discharge does not occur between the center electrode 22 and the inspection housing 100 since the inspection housing 100 does not include the ground electrode 23. Thus, the voltage generated in the ignition coil 3 is properly measured for quality inspection.

Furthermore, a withstand voltage inspection is performed on the inspection object A. If the inspection object A has passed both inspections, it is inserted in the ignition device housing 1 as shown in FIG. 2B and assembled to a product.

The discharge can be prevented by properly deciding the distance L. If the discharge does not occur, the voltage generated in the ignition coil is properly measured. Moreover, the portion that functions as an outer peripheral core is formed from the same material and in the same shape as the portion of the housing 1 having the same function. Therefore, about the same level of the voltage is generated in the ignition coil 3 in both cases that the ignition coil 3 is inserted in the housing 1 and the inspection housing 100. Therefore, the voltage measured during the inspection can be regarded as the voltage generated while the coil 3 is inserted in the housing 1.

The present invention should not be limited to the embodiment previously discussed and shown in the figures, but may be implemented in various ways without departing from the spirit of the invention. For example, the primary winding 31 may be positioned inside the secondary winding 32.

What is claimed is:

1. A method for inspecting an ignition device for an internal combustion engine having a combustion chamber, the device including an ignition plug for discharging in the combustion chamber, an ignition coil for supplying a high voltage to the ignition plug, and a cylindrical ignition device housing for housing the ignition plug and the ignition coil, the ignition device further including a ground electrode that is fixed to the ignition device housing, and a portion of the ignition device housing functions as an outer peripheral core of the ignition coil, wherein the device is inspected by measuring a voltage generated in the ignition coil, comprising:

preparing a cylindrical inspection housing for an inspection of the ignition device;

inserting the ignition coil in the inspection housing; and measuring the voltage generated in the ignition coil that is housed in the inspection housing, wherein the inspection housing functions as a housing substituted for the ignition device housing and an outer peripheral core of the ignition coil during the inspection, and the measuring is performed using the inspection housing that differs from the ignition device housing especially in that a ground electrode is not fixed to the inspection housing.

2. The method according to claim 1, wherein the inserting step further includes inserting the ignition plug in the inspection housing.

3. An inspection device for an ignition device for an internal combustion engine having a combustion chamber, the ignition device including an ignition plug for discharging in the combustion chamber, an ignition coil for supplying a high voltage to the ignition plug, and a cylindrical ignition device housing for housing the ignition plug and the ignition coil, the ignition device further including a ground electrode that is fixed to the ignition device housing, and a portion of the ignition device housing functions as an outer peripheral core of the ignition coil, comprising:

a cylindrical inspection housing that functions as a housing substituted for the ignition device housing and an outer peripheral core of the ignition coil during the inspection; and a voltage measuring means for measuring a voltage generated in the ignition coil in a condition that the ignition coil is housed in the inspection housing.

4. The inspection device according to claim 3, wherein the inspection housing is sized so that a distance is provided between an end thereof adjacent to a tip of the ignition plug and the tip of the ignition plug for preventing a discharge to occur between the inspection housing and the ignition plug even when the voltage generated in the ignition coil is applied to the ignition plug at a maximum level.

5. The inspection device according to claim 4, wherein the distance is decided based on atmospheric pressure and temperature at which the voltage generated in the ignition coil is measured.

6. The inspection device according to claim 3, wherein the inspection housing is formed from the same material and in the same shape as a portion of the ignition device housing that functions as an outer peripheral core of the ignition coil.

7. A method for inspecting an ignition device for an internal combustion engine having a combustion chamber, the device including an ignition plug for discharging in the combustion chamber, an ignition coil for supplying a high voltage to the ignition plug, and a cylindrical substitute/inspection housing for housing the ignition plug and the ignition coil, and a portion of the substitute housing functions as an outer peripheral core of the ignition coil, wherein the device is inspected by measuring a voltage generated in the ignition coil, comprising:

maintaining the substitute housing ungrounded;

providing electrical isolation between the ignition plug and the substitute housing by maintaining a distance between a tip of the ignition plug and a housing end adjacent to the tip for preventing an electrical discharge; and measuring the voltage generated in the ignition coil housed in the substitute housing.

* * * * *